US006364096B1

(12) United States Patent
De Baets et al.

(10) Patent No.: US 6,364,096 B1
(45) Date of Patent: Apr. 2, 2002

(54) SECURITY BOX FOR PAPERS, SUCH AS BANKNOTES, CHEQUES AND THE LIKE

(75) Inventors: Daniël De Baets, Gent; Danny Vandeputte, Maarkedal; Renaud Van Cauwenberge, Gent, all of (BE)

(73) Assignee: Nationale Bank van Belgie N.V., Brussels (BE)

( * ) Notice: Subject to any disclaimer, the term of this patent is extended or adjusted under 35 U.S.C. 154(b) by 0 days.

(21) Appl. No.: 09/674,760

(22) PCT Filed: May 7, 1998

(86) PCT No.: PCT/EP98/02691

§ 371 Date: Nov. 6, 2000

§ 102(e) Date: Nov. 6, 2000

(87) PCT Pub. No.: WO99/58416

PCT Pub. Date: Nov. 18, 1999

(51) Int. Cl.[7] ..... A45C 13/10
(52) U.S. Cl. ..... 206/1.5; 206/508; 220/210
(58) Field of Search ..... 206/1.5, 508; 220/210, 220/315, 318, 324

(56) References Cited

U.S. PATENT DOCUMENTS 4,470,518 A 9/1984 Stein
4,892,221 A * 1/1990 Gora et al. ..... 220/345.1
5,129,538 A * 7/1992 Bennett ..... 220/345.1
5,281,400 A * 1/1994 Berry, Jr. ..... 206/363

* cited by examiner

*Primary Examiner*—Shian Luong
(74) *Attorney, Agent, or Firm*—Maria Parrish Tungol

(57) ABSTRACT

A security storage box for papers, such as banknotes or cheques, comprising an open-topped container and lid separate from the container and being formed to close the open top of the container. The container comprises substantially continuous peripheral container flange. This horizontal container flange is being provided with a plurality of through apertures. The lid includes a horizontal, substantially continuous peripheral lid flange formed to overly the container flange and is provided with lid hooks, formed and aligned to engage with the container flange apertures. To improve the resistance of the boxes against fraud and pilferage, the container flange around its peripheral outer edges of the side and end walls is integrally connected to a security flange extending parallel to the side and end walls in the direction of the bottom wall, the lid being provided with a cover flange being formed to overly the security flange at the side and rear end walls.

12 Claims, 4 Drawing Sheets

SECURITY BOX FOR PAPERS, SUCH AS BANKNOTES, CHEQUES AND THE LIKE

Figure 1:
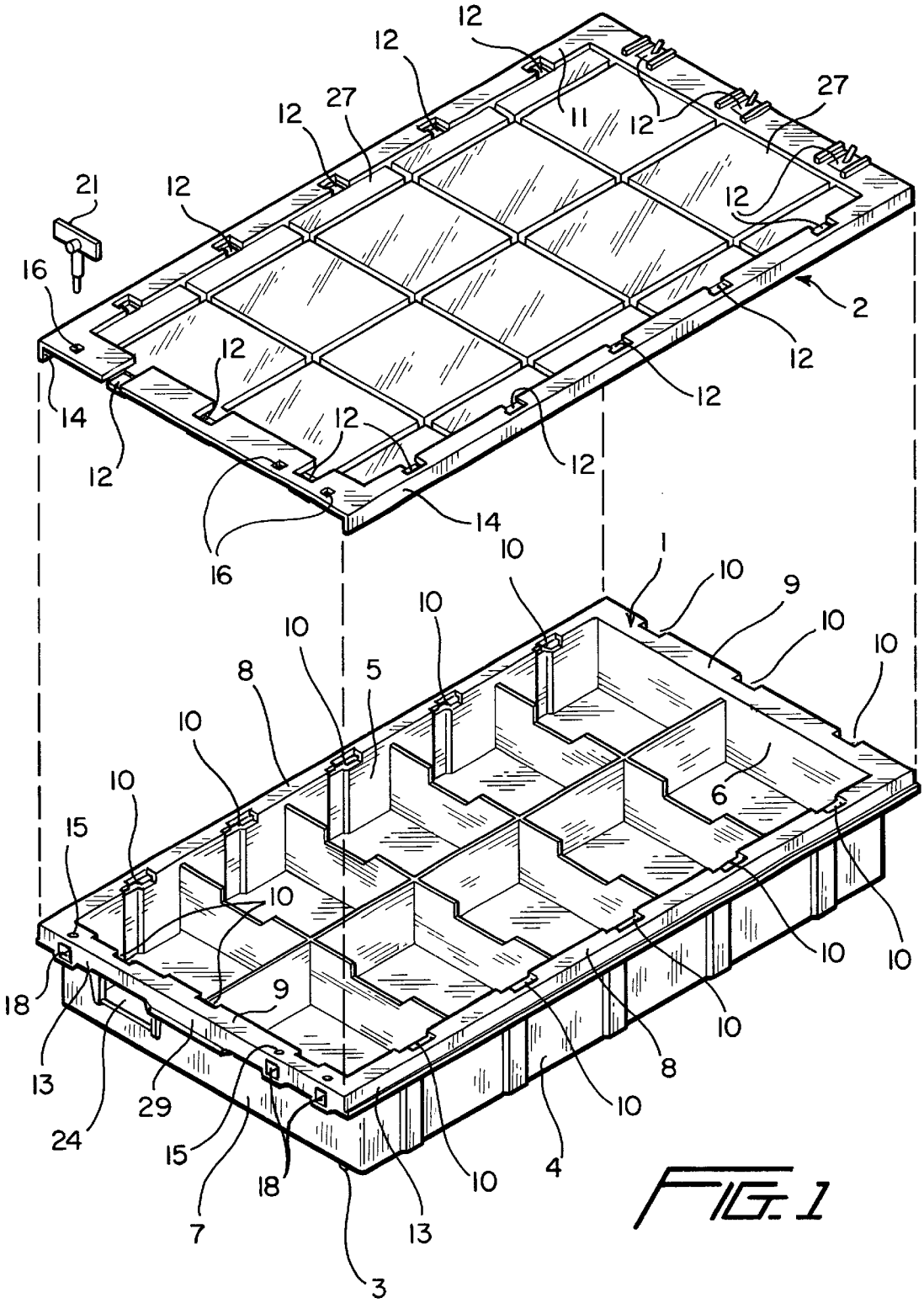

The invention relates to a security box for papers, such as banknotes, cheques and the like. Such security box normally comprises a bottom part, hereinafter also called container, and a cover or lid, which in closed position fully closes the open top of the container. The security box may be used for storing and transporting fraude, theft, robbery, pilferage and burglary and/or substitution sensible objects and/or documents such as currency, banknotes, security, valuable and/or confidential documents, information carriers or other valuable and/or substitution and/or modification sensible items and/or confidential objects.

Such a security box is on itself known, e.g. from U.S. Pat. No. 4,470,518. The container of this known security box comprises an open-topped container and a lid separate from the container and being formed to close the open top of the container. Said container comprises a horizontal, generally rectangular bottom wall integrally connected around its periphery with lower edges of vertical, opposed parallel side walls and vertical, opposed parallel rear end and front end walls. Said side and end walls are provided with integrally formed outwardly extending horizontal side and end flanges, respectively, said flanges being connected together around substantially the entire upper periphery of the container to constitute a horizontal, substantially continuous peripheral container flange which is provided with a plurality of through apertures and is integrally connected to a security flange extending parallel to the side and end walls in the direction of the bottom wall. Said lid has a horizontal, substantially continuous peripheral lid flange formed to overly the container flange which is provided with lid hooks, formed and aligned to engage with the container flange apertures, and with a cover flange being formed to overly the security flange at the side and rear end walls.

It is an object of the invention to improve the robustness of the security box against fraude and pilfering.

It is another object of the invention to prevent unauthorized replacement or substitution of labels carrying information with regard to the content of the security box.

It is also an object of the invention to allow easy transportation and stacking.

The invention has furthermore for its object to provide a security box having a shape and design which are suitable to allow the easy handling, transport and use of the security box in a robotised and computerised environment.

A security storage of the type referred to hereinabove according to the invention is therefore characterised by at least one, entirely closed, security sealing house depending from the outwardly extending horizontal front end flange, generally parallel to the front end wall, said housing being provided with peripheral sidewalls enclosing a generally cubiformed space being closed at the backside by a backwall, separated from the front end wall.

This measure not only strengthens the construction of the security sealing house as such, but also makes it difficult to break the security sealing padlock or gusset with a tool, such as a screwdriver or the like, as it is completely closed off.

As the back wall, the two peripheral side walls, the bottom and the top wall of this, preferably cubiform housing, are completery closed and separated from the front wall of the container, it is possible to keep a permanent and easy control against agression attempts.

A further constructive improvement in the robustness of the sealing against easy breaking or removing the closing security seal is characterised in that said security sealing house is provided with opposite through apertures in its top and bottom sidewalls for inserting therethrough the sealing padlock, thus allowing the use of sealing padlocks having multiple clamping elements. Instead of being clamped only in the opening in the top sidewall of the sealing house, now the sealing padlock is being clamped also in the opening in the bottom sidewall of the sealing house, therewith increasing the security of the padlocks, as well as further stabilizing and further increasing the grip resistance between the security seal and the sealing house.

Preferably such security box is characterized by various security sealing houses being provided at the front end wall, thus allowing a very safe padlocking by multiple intervention (i.e. intervention by successive different persons), which is nowadays becoming a standard procedure for handling high security documents and banknotes.

Another preferred embodiment according to the invention is characterized by a label housing provided with an opening at the peripheral container flange, the lid comprising a lidhook closing said label housing opening when locking the lid onto the container. The label housing can appropriately be provided with a protective window which is removeable/replaceable when the lid is removed from the container.

In interlocked lid-container assembly, the lid in this preferred embodiment covers the opening of the label housing, therewith preventing unauthorized replacement or substitution of labels carrying information with regard to the content of the security box.

In order to further improve the protection of the lid hooks from easy access and at the same time strengthen the construction of the container-lid assembly, the above security box according to the invention is characterized by reinforcement bridges connecting one of said sidewalls with the opposite security flange at each of the through apertures. The purpose of these bridges is not only to reinforce the container, but also to prohibit inserting a tool (e.g. a screw driver) horizontally between a hook of the cover or lid and the bottom side of the outward extending flange of the container, in order to attempt to lift a hook of the cover from its corresponding opening in the container.

Advantageously the container and/or the lid of the above security box according to the invention are molded in a synthetic resin, preferably by injection moulding. The moulded lid hooks may be reinforced by metal hook elements embedded and moulded into the resin, and/or the moulding resin may be reinforced with fibers selected from metal fibers, carbon fibers, glas fibers, and high strength synthetic fibers (such as KEVLAR—fibers, SPECTRA—fibers, and similar).

For easy transportation and stacking, such security box is characterized in that the lid is provided with a rectangular inset formed to correspond with the bottom wall of the container. The container may be provided with handles at the rear and front end walls.

Figure 2:
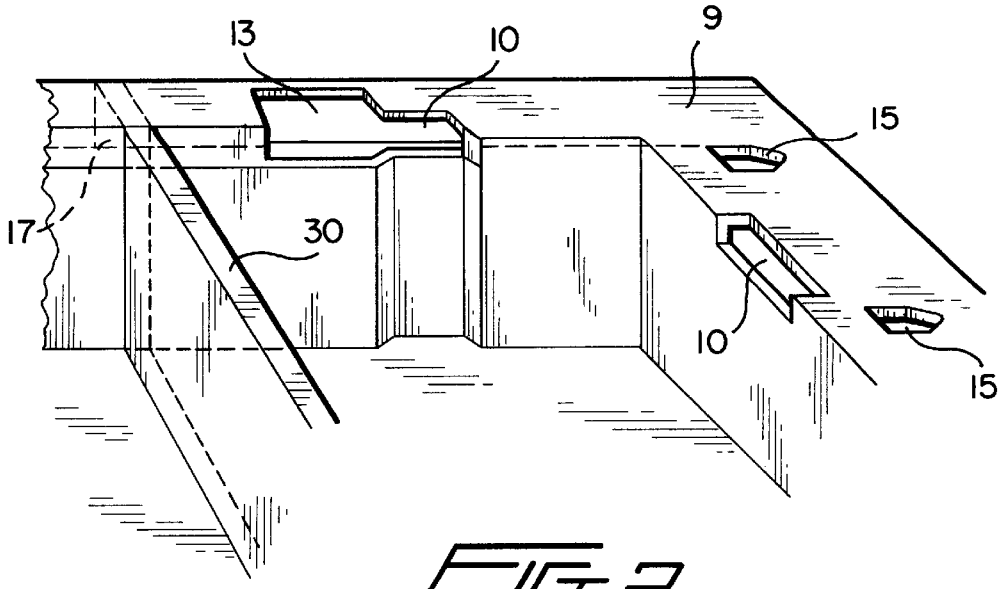
Figure 3:
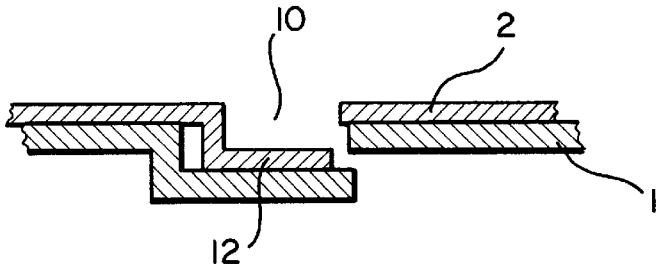
Figure 4:
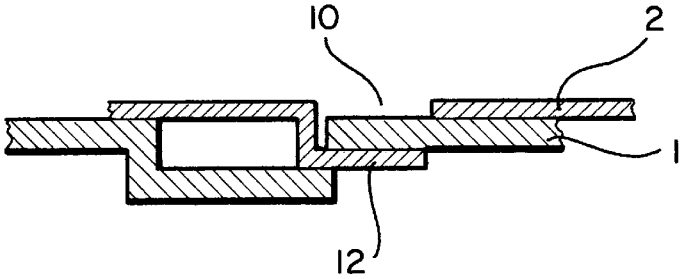
Figure 5:
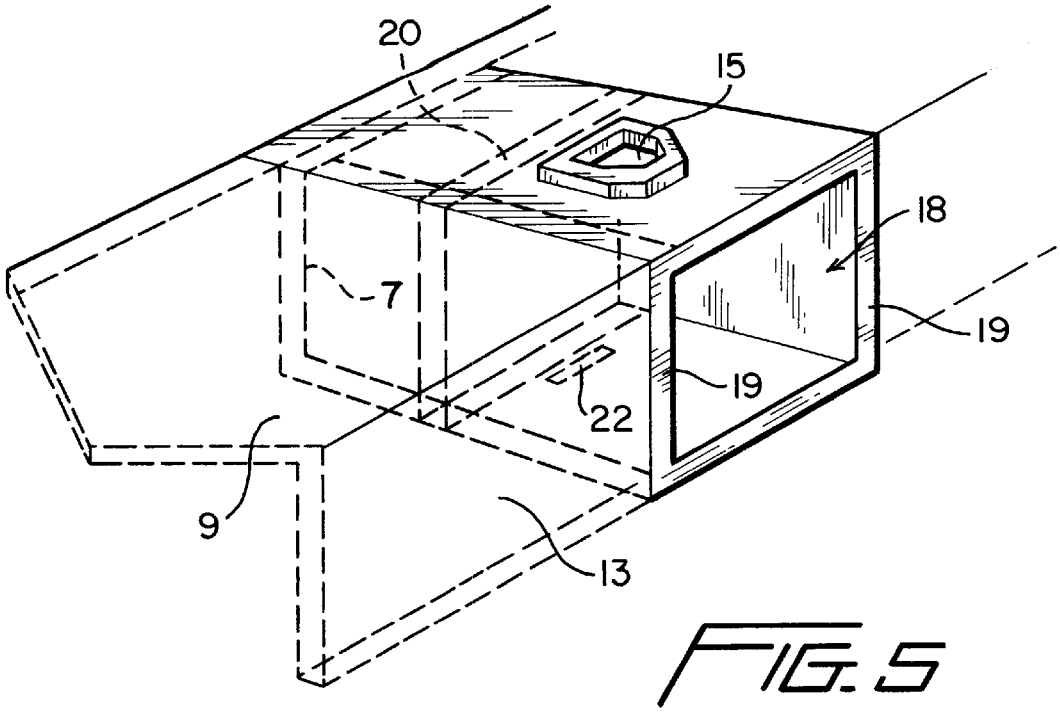
Figure 6:
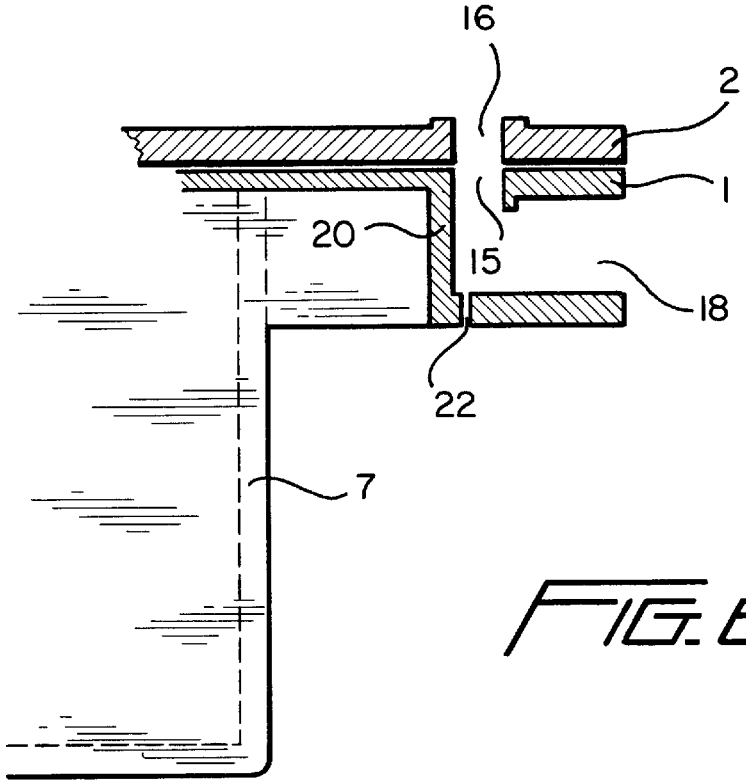
Figure 7:
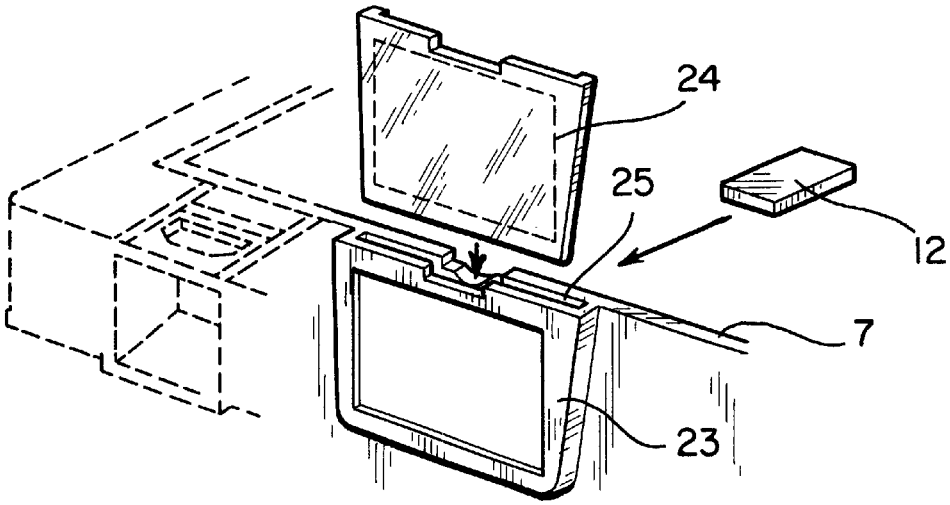

The invention is diagrammatically illustrated by way of example with reference to the accompanying drawings, in which corresponding reference numbers are used for like elements and showing in:

FIG. 1 a perspective view of a security box according to the invention;

FIG. 2 a partial perspective view of the security box of FIG. 1;

FIG. 3 a partial cross-sectional view of a through aperture and lid hook in disengaged position;

FIG. 4 a partial cross-sectional view of the through aperture and lid hook of FIG. 3 in locked position;

FIG. 5 a partial perspective view of the security box of FIG. 1 to show the security sealing house;

FIG. 6 a partial cross-sectional view of the security seal house of FIG. 5;

FIG. 7 a partial perspective view of the container to show the label housing.

Figure 8:
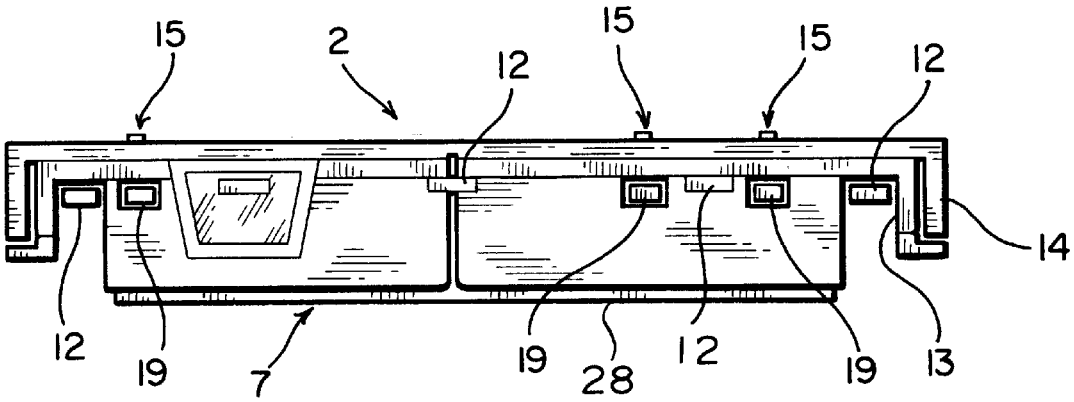

FIG. 8 is an elevational view of an other embodiment of the security box according to the invention.

FIG. 1 shows in perspective view a security box according to the invention, comprising an open-topped container 1 and a lid 2 separate from the container 1 and being formed to close the open top of the container 1. The container 1 comprises a horizontal, generally rectangular bottom wall 3 integrally connected around its periphery with lower edges of vertical, opposed parallel side walls 4 and 5 and vertical, opposed parallel rear end and front end walls 6 and 7, respectively. The side and end walls 4–7 are being provided at upper edges thereof with integrally formed outwardly extending horizontal side and end flanges 8 and 9, respectively. These flanges 8 and 9 are integrally connected together around substantially the entire upper periphery of the container 1 to constitute a horizontal, substantially continuous peripheral container flange 8,9.

The horizontal container flange 8,9 is provided with a plurality of through apertures 10.

The lid 2 is also provided with a horizontal, substantially continuous peripheral lid flange 11 formed to overly the horizontal container flange 8,9. Integrally formed with the lid are lid hooks 12, shaped and aligned to engage with the container flange through apertures 10. The horizontal container flange 8,9 around its peripheral outer edges of the side and end walls 4–7 is integrally connected to a vertical security flange 13, downwardsly depending, parallel to the side and end walls 4–7. The lid 2 at the outer edge of the rear end and side parts of its horizontal lid flange 11 is provided with a vertical side cover flanges 14 being formed to overly the corresponding parts of the security flange 13.

The through apertures 10 are generally evenly distributed over the side and end parts of the horizontal container flange 8,9. The lidhooks 12 are positioned onto the lid 2 in alignment therewith to allow these to extend through the through apertures 10, when the lid 2 is placed onto the container 1 in a closed position. FIG. 3 shows in more detail a lidhook 12 extending into a corresponding through aperture 10 in closed, disengaged, position.

From this closed position the lid 2 may be translated horizontally in the direction of the front end wall 7 of the container 1, to assume a lock position, in which the lidhooks 12 engage with the aperture edge portions of the horizontal container flange 8,9. FIG. 4 shows in more detail a lidhook 12 engaging with a corresponding through aperture 10 in lock position.

In this lock position, access to the lidhooks 12 is hindered by the security flange 13. The protection therewith provided is amplified by the side cover flanges 14 of the lid 2. To strengthen the construction of the security flange and at the same time further improve the protection of the lidhooks from being destructively disengaged, the container 2 is provided with reinforcement bridges 17 connecting the security flange 13 to the respective opposite vertical side- and end walls.

Turning back to FIG. 1 now, in addition to the through apertures 10, the horizontal container flange 8,9 and the horizontal lid flange 11 both at the front end part are being provided with corresponding seal apertures 15, respectively 16. FIG. 5 shows in more detail a portion of the container 1 at its upper edge (corresponding to the lower right comer of the box on FIG. 1). In lock position the seal apertures 15 of the container 1 are in alignment with the corresponding seal apertures 16 of the lid (see FIG. 6), allowing to receive therein a sealing lock 21, gusset or the like to secure sealing of this locked position.

The security flange 13 at its front end part is provided with various (e.g. three) cubiformed security sealing houses 18, depending from the outwardly extending horizontal front end flange 9, generally parallel to the front end wall 7, each of said houses 18 being provided with peripheral sidewalls 19 enclosing a generally cubiformed space being closed at the backside by a backwall 20, separated from the front end wall 7. Such a cubiformed sealing house 18 is shown in more detail in FIGS. 5 and 6. In addition to the seal aperture 15, which extends through the top sidewall of the security sealing house 18, FIGS. 5 and 6 also show a slitformed through aperture 22 in the bottom sidewall of the security sealing house 18, opposite to the through aperture 15. The aperture 22 is to receive the foot of the sealing pads lock 21. This provides a stabilized and firm sealing of the padlock 21.

The security storage box of FIG. 1 also includes a label housing 23 at the vertical front end wall 7 of the container 1, having a transparent protecting window 24. FIG. 7 shows in more detail the label housing 23, which is provided with an opening 25 at the outer edge of the peripheral horizontal container flange 9 to insert therein one or more information labels. A lidhook 12 is formed and aligned to close off the opening 25, when the lid 2 is locked onto the container 1. In this locked position the label is secured from unauthorized substitution or replacement by a false label.

Preferably the container 1 and the lid 2 are moulded in a synthetic resin (e.g. highly resistant injection moulded polycarbonate). By the choise of such type of material it is achieved that using tools to break in into the box by force, is leaving clearly visible damages, and/or traces of violence, on parts of the box and/or on the security seal (s). The material used for the lid may preferably be transparent.

To allow easy stacking of various locked security boxes, the lid 2 is provided with a rectangular inset 27 (see FIG. 1) formed to correspond with the bottom wall 3 of the container 1 or with a foot 28 on the bottom wall 3 of the container 1 (see embodiment of FIG. 8).

For easy transportation, the container 1 of the security storage box may be provided with handles 29 at the rear and front end walls (see FIG. 1).

Furthermore the container 1 is divided into generally identical compartments by compartment seperating walls 30, which are preferably moulded in one piece with the body of the container 1, therewith further adding to the constructive strength thereof.

What is claimed is:

1. A security storage box comprising an open-topped container and a lid, said container comprising a horizontal, generally rectangular bottom wall (3), vertical, opposed parallel side walls (4, 5) and vertical, opposed parallel rear end and front end walls, (6, 7) wherein the periphery of the bottom wall (3) is integrally connected with lower edges of vertical, opposed parallel side walls (4, 5) and vertical, opposed parallel rear end and front end walls, (6, 7) wherein the upper edges of said side walls (4, 5) and rear end and front end walls (6,7) are provided with integrally formed outwardly extending horizontal side and end flanges (8, 9), respectively, said flanges being connected together around substantially the entire upper periphery of the container to constitute a horizontal, substantially continuous peripheral container flange which is provided with a plurality of container flange apertures and is integrally connected to a security flange (13) extending parallel to the side and end walls in the direction of the bottom wall, said lid having a horizontal, substantially continuous peripheral lid flange (11) formed to overly the container flange wherein the lid flange (11) is provided with lid hooks to engage the container flange apertures, and with a cover flange (14) formed to overly the security flange (13) at the side and rear end walls, characterized in that said security box comprises at least one security sealing house depending from the outwardly extending front end flange at the upper edge of the front wall end wall (7), generally parallel to the front end wall, wherein said house is provided with peripheral sidewalls (19) and a backwall (20) enclosing a generally cubiformed space, separated from the front end wall.

2. A security storage box according to claim 1, characterised in that the top of said security sealing house is provided with an aperture for inserting therethrough a sealing lock.

3. A security storage box according to claim 2, characterised in that the bottom of said security sealing house is provided with an aperture opposite the aperture in the top of said security sealing house.

4. A security box according to claim 2, characterized in that said container and/or said lid are moulded from a synthetic resin, whereas the resin is reinforced with fibers selected from metal fibers, carbon fibers, glass fibers, and high strength synthetic fibers.

5. A security storage, box according to claim 1 characterised by a plurality of security sealing houses being provided at the front end flange.

6. A security storage box according to claim 1, characterized by a label housing provided with an opening at the horizontal peripheral container flange, the lid comprising a lid hook closing said label housing opening when locking the lid onto the container.

7. A security storage box according to claim 4, characterized in that the label housing is provided with a protective window which is removeable/replaceable when the lid is removed from the container.

8. A security storage box according to claim 1, characterized by reinforcement bridges connecting one of said sidewalls with the opposite security flange at each of the through apertures.

9. A security storage box according to claim 1, characterized in that said container and/or said lid are moulded from a synthetic resin, whereas the lid hooks are reinforced by metal hook elements embedded and moulded into the resin.

10. A security storage box according to claim 1, characterized in that said container and/or said lid are injection moulded from a synthetic resin.

11. A security storage box according to claim 1, characterized in that the lid is provided with a rectangular inset formed to correspond with the bottom wall of the container to allow easy stacking.

12. A security storage box according to claim 1, characterized in that container is provided with handles at the rear and front end walls.

* * * * *